US009415610B2

(12) United States Patent
O'Neil et al.

(10) Patent No.: US 9,415,610 B2
(45) Date of Patent: Aug. 16, 2016

(54) SYSTEM AND METHOD FOR FORMING HYDROPHOBIC STRUCTURES IN A POROUS SUBSTRATE

(71) Applicant: Xerox Corporation, Norwalk, CT (US)

(72) Inventors: Jason O'Neil, Rochester, NY (US); Jing Zhou, Rochester, NY (US); Mandakini Kanungo, Penfield, NY (US); Nancy Y. Jia, Webster, NY (US); Paul J. McConville, Webster, NY (US); Wei Hong, Amherst, MA (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/311,909

(22) Filed: Jun. 23, 2014

(65) Prior Publication Data

US 2015/0367654 A1 Dec. 24, 2015

(51) Int. Cl.

| | |
|---|---|
| ***B41J 11/00*** | (2006.01) |
| ***B41J 13/02*** | (2006.01) |
| ***D21H 23/56*** | (2006.01) |
| ***D21H 25/06*** | (2006.01) |
| ***D21H 17/60*** | (2006.01) |
| ***D21H 19/18*** | (2006.01) |
| ***G03G 9/087*** | (2006.01) |

(52) U.S. Cl.

CPC ..... *B41J 11/002* (2013.01); *B41J 11/0015* (2013.01); *B41J 13/025* (2013.01); *D21H 17/60* (2013.01); *D21H 19/18* (2013.01); *D21H 23/56* (2013.01); *D21H 25/06* (2013.01); *G03G 9/08782* (2013.01)

(58) Field of Classification Search

CPC ..... B41J 2002/012; B41J 2/015; B41J 2/04

See application file for complete search history.

(56) References Cited

U.S. PATENT DOCUMENTS

| | | | | |
|---|---|---|---|---|
| 2,712,508 | A | 7/1955 | Massey | |
| 3,145,118 | A | 8/1964 | Mahoney | |
| 3,982,056 | A | 9/1976 | Holder, Jr. | |
| 4,606,264 | A | 8/1986 | Agronin et al. | |
| 5,891,228 | A * | 4/1999 | Baker et al. | 106/31.31 |
| 6,196,675 | B1 * | 3/2001 | Deily et al. | 347/103 |
| 7,267,938 | B2 | 9/2007 | Anderson et al. | |

(Continued)

FOREIGN PATENT DOCUMENTS

GB 1 050 651 12/1966

OTHER PUBLICATIONS

Bracher et al.; Patterned paper as a template for the delivery of reactants in the fabrication of planar materials; The Royal Society of Chemistry Journal; Jun. 10, 2010; pp. 4303-4309.

(Continued)

*Primary Examiner* — Kristal Feggins
*Assistant Examiner* — Kendrick Liu
(74) *Attorney, Agent, or Firm* — Maginot Moore & Beck LLP

(57) ABSTRACT

An apparatus for distributing a hydrophobic material in a substrate includes a first roller, second roller that engages the first roller to form a nip, a heater operatively connected to the first roller and configured to heat the first roller to a first temperature that is greater than a second temperature of the second roller, and a substrate transport configured to move a substrate through the nip at a predetermined velocity. The first roller engages a first side of the substrate and the second roller engages a second side of the substrate to enable the hydrophobic material to penetrate into the substrate.

18 Claims, 9 Drawing Sheets

(56) References Cited

U.S. PATENT DOCUMENTS

| | | | | |
|---|---|---|---|---|
| 8,377,710 | B2 | 2/2013 | Whitesides et al. | |
| 8,574,924 | B2 | 11/2013 | Sia et al. | |
| 8,603,832 | B2 | 12/2013 | Whitesides et al. | |
| 2001/0041222 | A1 | 11/2001 | Gilfert et al. | |
| 2005/0111861 | A1* | 5/2005 | Calamita et al. | 399/66 |
| 2010/0145491 | A1 | 6/2010 | Troian | |
| 2010/0247197 | A1* | 9/2010 | Okamoto | G03G 15/0131 399/388 |
| 2011/0111517 | A1 | 5/2011 | Siegel et al. | |
| 2011/0123398 | A1 | 5/2011 | Carrilho et al. | |
| 2011/0292142 | A1* | 12/2011 | LeFevre et al. | 347/101 |
| 2012/0198684 | A1 | 8/2012 | Carrilho et al. | |
| 2012/0328905 | A1 | 12/2012 | Guo et al. | |
| 2013/0034869 | A1 | 2/2013 | Whitesides et al. | |

OTHER PUBLICATIONS

Martinez et al.; Diagnostics for the Developing World: Microfluidic Paper-Based Analytical Devices; Analytical Chemistry; Jan. 1, 2010; pp. 3-10; vol. 82, Issue No. 1; American Chemical Society.

European Search Report and Written Opinion of the European Patent Office corresponding to EP Application No. 15171395.5, European Patent Office, Munich, Germany, Nov. 2, 2015 (5 pages).

* cited by examiner

SYSTEM AND METHOD FOR FORMING HYDROPHOBIC STRUCTURES IN A POROUS SUBSTRATE

TECHNICAL FIELD

This disclosure relates generally to systems and methods for controlling the deposition of a hydrophobic material in a porous substrate and, more particularly, to systems and methods for forming a hydrophobic material in paper as part of a chemical assay device to control diffusion of a fluid through the paper.

BACKGROUND

Paper-based chemical assay devices include a paper substrate, wax that forms fluid channels and other fluid structures in the paper, and one or more reagents. Common examples of paper-based chemical assay devices include biomedical testing devices that are made of paper and perform biochemical assays and diagnostics in test fluids such as blood, urine and saliva. The devices are small, lightweight and low cost and have potential applications as diagnostic devices in healthcare, military and homeland security to mention a few. The current state of the art paper diagnostic device is limited on fluidic feature resolution and manufacturing compatibility due to uncontrolled reflow of the wax channel after the wax is printed on the paper.

FIG. 10A and FIG. 10B depict the prior art processes for melting wax that is formed on a paper substrate in a reflow oven. The melting process is required for the wax to penetrate into the paper instead of remaining in a layer on the surface of the paper. In FIG. 10A, a reflow oven heats a paper substrate with solidified wax to a temperature of approximately 150° C. The entire paper and the wax are heated to the same temperature in an isotropic manner. As depicted in FIG. 10B, the wax melts and spreads both into the porous paper and across the surface of the paper in a roughly uniform manner. The prior art reflow oven cannot control the direction of flow for the melted wax, and the melted wax tends to spread across the surface of paper to a greater degree than is desired. In a biomedical testing device, the wax is formed in lines and other structures that act as barriers and channels to fluids that diffuse through the paper substrate. The uncontrolled spread of the wax presents difficulties in forming the barriers and liquid channels with precise shapes. Consequently, improvements to the control the flow of a hydrophobic material that is deposited on a porous substrate would be beneficial.

SUMMARY

In one embodiment, an apparatus that distributes a hydrophobic material in a substrate has been developed. The apparatus includes a first roller, a second roller configured to engage the first roller to form a nip, a first heater operatively connected to the first roller and configured to heat the first roller to a first temperature that is greater than a second temperature of the second roller, and a substrate transport configured to move a substrate through the nip at a predetermined velocity to enable the first roller to engage a first side of the substrate and the second roller to engage a second side of the substrate, the second side of the substrate bearing the hydrophobic material that penetrates into the substrate in response to a temperature gradient in the nip between the first roller and the second roller.

In another embodiment, a method for distribution of a hydrophobic material in a substrate has been developed. The method includes engaging a first roller with a second roller to form a nip, heating the first roller with a first heater operatively connected to the first roller to heat the first roller to a first temperature that is greater than a second temperature of the second roller, and moving a substrate having a first side and a second side through the nip at a predetermined velocity with a substrate transport to enable the first roller to engage the first side of the substrate and the second roller to engage the second side of the substrate, the second side of the substrate bearing the hydrophobic material that penetrates into the substrate in response to a temperature gradient in the nip between the first roller and the second roller.

BRIEF DESCRIPTION OF THE DRAWINGS

The foregoing aspects and other features of an apparatus that controls the distribution of a hydrophobic material on a substrate are explained in the following description, taken in connection with the accompanying drawings.

DETAILED DESCRIPTION

Figure 1:
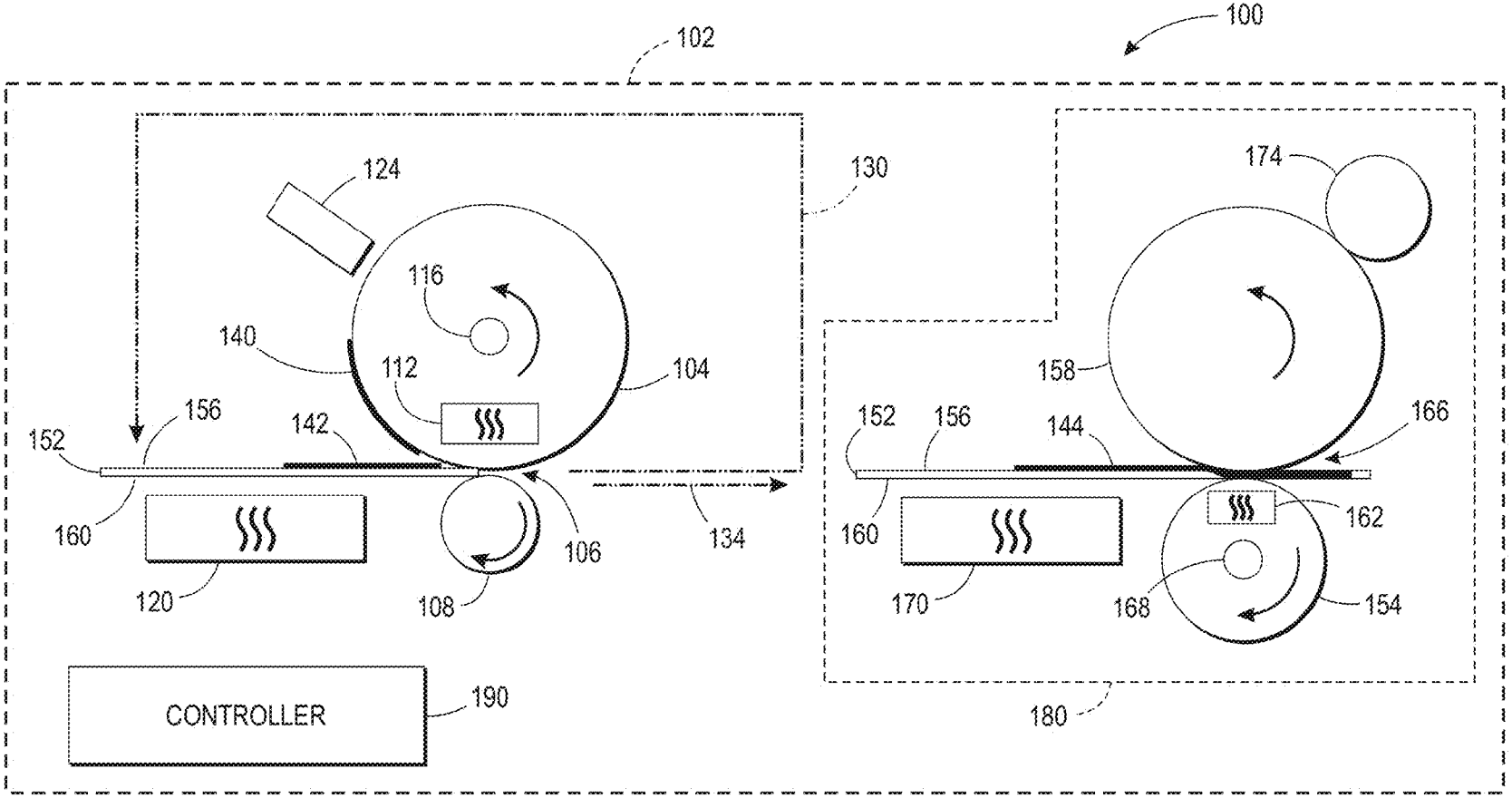
FIG. 1 is a diagram of an inkjet printer that includes an apparatus that applies heat and pressure to hydrophobic material on a surface of a substrate to enable the hydrophobic material to penetrate the substrate.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces images with resins or colorants on media, such as digital copiers, bookmaking machines, facsimile machines, multi-function machines, or the like. In the description below, a printer is further configured to deposit a melted wax, phase-change ink, or other hydrophobic material onto a porous substrate, such as paper. While the printers described below are inkjet printers and the hydrophobic phase change material can be a phase-change ink in some embodiments, in some configurations the hydrophobic material is an optically transparent wax or other material that does not have a particular color. The visual representations of the hydrophobic material that are presented below are for illustrative purposes only, and different embodiments described below use hydrophobic materials with no coloration or with any coloration that is suitable for use with a chemical assay device.

The printer is optionally configured to apply a temperature gradient and pressure to the substrate that spreads the hydrophobic material and enables the hydrophobic material to penetrate into the porous substrate to form hydrophobic structures including channels and barriers that control the capillary flow of liquids, including water, through the substrate.

As used herein, the terms "hydrophilic material" and "hydrophilic substrate" refer to materials that absorb water and enable diffusion of the water through the material via capillary action. One common example of a hydrophilic substrate is paper, such as cellulose filter paper, chromatography paper, or any other suitable type of paper. The hydrophilic substrates are formed from porous materials that enable water and other biological fluids that include water, such as blood, urine, saliva, and other biological fluids, to diffuse into the substrate. As described below, a hydrophobic material is embedded in the hydrophilic substrate to form fluid channel barriers and other hydrophobic structures that control the diffusion of the fluid through the hydrophilic substrate.

As used herein, the term "hydrophobic material" refers to any material that resists adhesion to water and is substantially impermeable to a flow of water through capillary motion. When embedded in a porous substrate, such as paper, the hydrophobic material acts as a barrier to prevent the diffusion of water through portions of the substrate that include the hydrophobic material. The hydrophobic material also acts as a barrier to many fluids that include water, such as blood, urine, saliva, and other biological fluids. As described below, the hydrophobic material is embedded in a porous substrate to form channel walls and other hydrophobic structures that control the capillary diffusion of the liquid through the substrate. In one embodiment, the substrate also includes biochemical reagents that are used to test various properties of a fluid sample. The hydrophobic material forms channels to direct the fluid to different locations in the substrate that have deposits of the chemical reagents. The hydrophobic material is also substantially chemically inert with respect to the fluids in the channel to reduce or eliminate chemical reactions between the hydrophobic material and the fluids. A single sample of the fluid diffuses through the channels in the substrate to react with different reagents in different locations of the substrate to provide a simple and low-cost device for performing multiple biochemical tests on a single fluid sample.

As used herein, the term "phase-change material" refers to a hydrophobic material with a solid phase at room temperature and standard atmospheric pressure (e.g. 20° C. and one atmosphere of pressure) and a liquid phase at an elevated temperature and/or pressure level. Examples of hydrophobic phase-change materials used herein include wax and phase-change ink. As used herein, the term "phase-change ink" refers to a type of ink that is substantially solid at room temperature but softens and liquefies at elevated temperatures. Some inkjet printers eject liquefied drops of phase-change ink onto indirect image receiving surfaces, such as a rotating drum or endless belt, to form a latent ink image. The latent ink image is transferred to a substrate, such as a paper sheet. Other inkjet printers eject the ink drops directly onto a print medium, such as a paper sheet or an elongated roll of paper. In a liquid state, the phase-change material can penetrate a porous substrate, such as paper.

In a traditional inkjet printer, the phase change ink is transferred to one side of a substrate, with an option to transfer different phase change ink images to two sides of a substrate in a duplex printing operation. The printer spreads the phase change ink drops on the surface of the substrate, and the phase change ink image cools and solidifies on the surface of the print medium to form a printed image. The embodiments described below, however, apply heat and pressure to phase-change ink or another hydrophobic material on the surface of the substrate to enable the hydrophobic material to penetrate through the porous material in the substrate to form a three-dimensional barrier through the thickness of the substrate that controls the diffusion of fluids through the substrate.

FIG. 1 depicts an inkjet printer 100 that includes an apparatus 180 for applying a heat gradient and pressure to a hydrophilic substrate, such as paper, to enable a flow of a hydrophobic material into pores of the substrate to form barriers and channels that control diffusion of a fluid through the hydrophilic substrate. As used herein, a reference to the term "apparatus," unless expressly referred to otherwise, refers to a device that applies a heat gradient and pressure to a substrate to enable a hydrophobic material formed on a surface of the substrate to penetrate into the substrate with an anisotropic spread pattern. The apparatus is optionally incorporated into a printer, such as an inkjet printer. As described below, while the apparatus 180 is depicted in FIG. 1 as part of an indirect inkjet printer 100, the apparatus 180 can be incorporated into other printing devices or can be an independent device that is configured to process substrates that have a hydrophobic material formed on a surface using an inkjet printer or any other suitable application device.

The printer 100 includes an imaging drum 104, transfix roller 108, imaging drum heater 112, rotating actuator 116, and substrate heater 120. The printer 100 includes one or more inkjet printheads 124 that eject liquefied drops of a phase-change ink or other hydrophobic material onto a surface of the imaging drum 104. The imaging drum 104 and transfix roller 108 engage each other in a nip 106. In the printer 100, mechanical, pneumatic, or hydraulic actuators hold the imaging drum 104 and transfix roller 108 together to form the nip 106 and apply pressure to a substrate that passes through the nip 106. In some embodiments, the actuators also move the imaging drum 104 and transfix roller 108 into engagement to form the nip 106 or out of engagement. The rotating actuator 116 is, for example, an electric motor that rotates the imaging drum 104 at a range of selected velocities. The transfix roller 108 rotates in response to the motion of the imaging drum 104 when engaged to the imaging drum 104.

In the apparatus 180, a substrate transport propels a substrate in a direction indicated by the arrow 130 to pass through the nip 106. The substrate transport includes one or more actuators and belts, rollers, and other transport devices that move the substrate through the nip 106 in synchronization with the motion of the imaging drum 104 and transfix roller 108. The imaging drum 104 and transfix roller 108 are part of the substrate transport system that propels the substrate through the nip 106. In an embodiment where the apparatus 180 is incorporated in an inkjet printer, the media transport system in the printer transports the substrate to the apparatus 180 and the substrate moves through the nip 166 formed between the first roller 154 and second roller 158 in the apparatus 180.

In the apparatus 180, the cleaner roller 174 is formed with a silicone surface layer or another surface layer that removes the phase-change ink or other hydrophobic material from the surface of the second roller 158. The second roller 158 is typically coated with a low surface energy material, such as polytetrafluoroethylene or another suitable coating, to reduce the adhesion between the second roller 158 and the hydrophobic material 144. During operation, a small portion of the hydrophobic material 144 may adhere to the second roller 158, and the cleaner roller 174 removes the residual hydrophobic material to prevent contamination of subsequent substrates that pass through the nip 166.

FIG. 1 depicts a configuration of the apparatus 180 in an embodiment where the apparatus 180 is part of an inkjet printer. In FIG. 1, a digital electronic control unit (ECU), which is depicted as the controller 190, receives digital image data corresponding to predetermined patterns and shapes for the hydrophobic material that are to be formed on the substrate. In the apparatus 180, the printheads 124 eject drops of a phase-change ink onto the surface of the imaging drum 104 to form the latent ink image 140. In one embodiment, the imaging drum 104 completes multiple rotations past the printheads 124 and the printheads 124 form an additional layer of phase-change ink during each rotation that is transferred to the substrate 152. In one embodiment of the printer 100, an actuator (not shown) removes the transfix roller 108 from engagement with the imaging drum 104. The actuator 116 rotates the imaging drum 104 past the printhead 124 and the imaging drum 104 receives a latent ink image from the printhead 124 over the course of two or more rotations. In one embodiment, the printhead 124 forms four layers of a single latent ink image on the surface of the imaging drum 104. Once the latent ink image is formed on the imaging drum 104, the transfix roller 108 engages the imaging drum 104 and the substrate 152 passes through the nip 106 to receive the multi-layer latent ink image.

In another embodiment of FIG. 1, the printer 100 passes the substrate 152 through the nip 106 two or more times to form a printed image from multiple layers of ink. For example, in FIG. 1 a first layer of the phase-change ink 142 is formed on the surface 156 of the substrate 152. The media transport moves the substrate 152 as indicated by path 130 to pass through the nip 106 a second time as the imaging drum 104 carries an additional layer of phase-change ink 140 that is ejected by the printhead 124. The media path 130 does not include a duplexing unit that is commonly used for two-sided printing in a printer to enable the side 156 of the substrate 152 to engage the imaging drum 104 during each pass through the nip 106. In one configuration, the controller 190 operates the printhead 124 to form the same image during each pass of the substrate 152 so that a single printed pattern of the phase-change ink is formed on one side of the substrate. For example, the latent ink image 140 is aligned with the ink image 142 that is already formed on the substrate 152, to form the combined image 144 that includes the combined volumes of phase-change ink in the images 140 and 142. The multiple passes enable the printer 100 to deposit a greater amount of the phase-change ink on the substrate 152 than is commonly used for conventional printing operations. In some embodiments, the printer 100 passes the substrate 152 through the nip 106 four times to form four layers of the phase-change ink on one side of the substrate 152.

In FIG. 1, the substrate transport moves the substrate 152, such as a sheet or elongated roll of paper, through the nip 106. In one embodiment, the imaging drum heater 112 heats the surface of the imaging drum 104 to 57° C. and the actuator 116 rotates the imaging drum 104 and transfix roller 108 at a linear surface velocity of five inches per second (IPS) to transfer the latent hydrophobic material image 144 to one side 156 of the substrate 152. In alternative embodiments, the transfix velocity is faster or slower to adjust for the "dwell time" of the print medium 152 in a nip. As used herein, the term "dwell time" refers to an amount of time that a given portion of the print medium 152 spends in a nip to receive heat and pressure from the rollers that form the nip. The amount of dwell time is related to the surface areas of the rollers that form the nip and the linear velocity of the substrate through the nip. For example, in the nip 166 the dwell time is related to the surface areas of the rollers 154 and 158 and the linear velocity of the substrate 152 through the nip 166. The dwell time is selected to enable the hydrophobic material to penetrate the substrate to form walls for fluid channels and other hydrophobic structures in the substrate. The selected dwell time can vary based on the thickness and porosity of the print medium 152, the temperature gradient in the nip 166, the pressure in the nip 166, and the viscosity characteristics of the hydrophobic material. Larger rollers typically form a nip with a larger surface area. Thus, one embodiment of the apparatus 180 with larger roller diameters operates with a higher linear velocity to achieve the same dwell time as another embodiment of the apparatus 180 with smaller diameter rollers and a lower linear velocity. In different operating modes of the apparatus 180, the selected dwell time is in a range of approximately 0.1 seconds to 10 seconds.

A blank side 160 of the print medium 152 engages the transfix roller 108 during an imaging operation. The heat and pressure in the nip 106 spreads the hydrophobic 140 material on the surface of the substrate 152 to form a printed image on the first side 156, with the hydrophobic material 140 combining with the hydrophobic material 142 in the multi-pass embodiment of FIG. 1. After the imaging operation that is depicted in FIG. 1, a substantial portion of the hydrophobic material 144 remains on or near the surface 156 of the substrate 152.

In the printer 100, the media transport moves the substrate 152 to the apparatus 180 after one or more passes of the substrate 152 to receive the printed image 144. The media transport moves the substrate as indicated by the path 134 to the apparatus 180. The apparatus 180 includes a first roller 154, a second roller 158, an optional substrate heater 170, and a cleaner roller 174. The first roller 154 and second roller 158 engage each other to form a nip 166. In the apparatus 180, mechanical, pneumatic, or hydraulic actuators hold the rollers 154 and 158 together to form the nip 166 and apply pressure to a substrate that passes through the nip 166. The first roller 154 and second roller 158 apply pressure to the substrate 152 and hydrophobic material 144 with a pressure of 1,000 pounds per square inch (PSI) in the embodiment of FIG. 1. In other configurations, the pressure in the nip 166 is between 800 PSI and 3,000 PSI and is selected based on the properties of the substrate and composition of the hydrophobic material. A heater 162 is operatively connected to the first roller 154 and is configured to heat the first roller 154 to a higher temperature than the second roller 158. The media transport moves the substrate 152 through the nip 166 after the hydrophobic material 144 has been transferred to the side 156 of the substrate 152.

In the example of FIG. 1, an actuator 168 rotates the first roller 154 to enable the substrate 152 to move through the nip 166 in the direction 134 while the second roller 158 rotates freely while engaging the printed side 156 of the substrate 152 that bears the hydrophobic material 144. The elevated temperature of the first roller 154 forms a temperature gradient in the nip 166, and the first roller 154 engages the second side 160 of the substrate 152. As described below, the temperature gradient enables the printed pattern of the hydrophobic material 144 to penetrate the thickness of the substrate 152 while reducing the lateral spread of the hydrophobic material 144.

In the apparatus 180 the optional substrate heater 170 elevates the temperature of the substrate to a predetermined temperature as the substrate passes through the nip 166. In one embodiment, the substrate heater 170 heats the substrate to 60° C. as the substrate approaches the nip 166. The roller heater 162 heats the surface of the first roller 154 to approximately 100° C. while the surface of the second roller 158 remains at a lower temperature of approximately 60-70° C. In one embodiment, the second roller 158 includes a larger diameter than the first roller 154 to enable the surface of the second roller 158 to cool after engaging the higher temperature first roll 154 in the nip 166. In other embodiments, the rollers are substantially equal in size or the first roller 154 is larger in diameter than the second roller 158. The roller heater 162 and substrate heater 170 are embodied as electric radiant heaters in the apparatus 180. In the embodiment of FIG. 1, the actuator 168 rotates the first roller 154 and second roller 158 at a linear velocity of approximately one inch per second as the substrate 152 passes through the nip 166. The linear velocity of the substrate 152 is inversely proportional to the dwell time in the nip 166. The dwell time is affected by the surface areas of the rollers 154 and 158, which affect the physical size of the nip 166, and the linear velocity of the substrate 152. In the apparatus 180, the dwell time is between approximately 0.1 seconds to 10 seconds and the controller 190 adjusts the linear velocity of the substrate 152 to produce a selected dwell time in the nip 166.

In alternative embodiments, the operating parameters of the apparatus 180 are adjusted to modify the temperature gradient in the nip 166 and the dwell time of the substrate 152 in the nip 166 to control the penetration of the hydrophobic material 144 through the substrate 152. In different embodiments of the apparatus 180, the temperature gradient and pressure in the nip 166, and the dwell time of the substrate 152 in the nip 166 are adjusted to produce a selected dwell time for rollers with different diameters.

FIG. 1 depicts the apparatus 180 as the substrate 152 that already bears hydrophobic material 144 on one side 156 passes through the nip 166 where pressure and a temperature gradient are applied to the substrate 152 to enable the hydrophobic material 144 to penetrate into the porous material of the substrate 152. In FIG. 1, the substrate transport moves the substrate through the nip 166 with the side 156 bearing the hydrophobic material engaging the second roller 158 while the blank side 160 engages the first roller 154. The apparatus 180 is depicted in the printer 100 where the printer 100 forms printed patterns of the hydrophobic material. In another embodiment, however, the apparatus 180 receives a substrate and hydrophobic material that are formed in a separate inkjet printing device or through any suitable deposition process that forms the hydrophobic material on one surface of the substrate.

Figure 2:
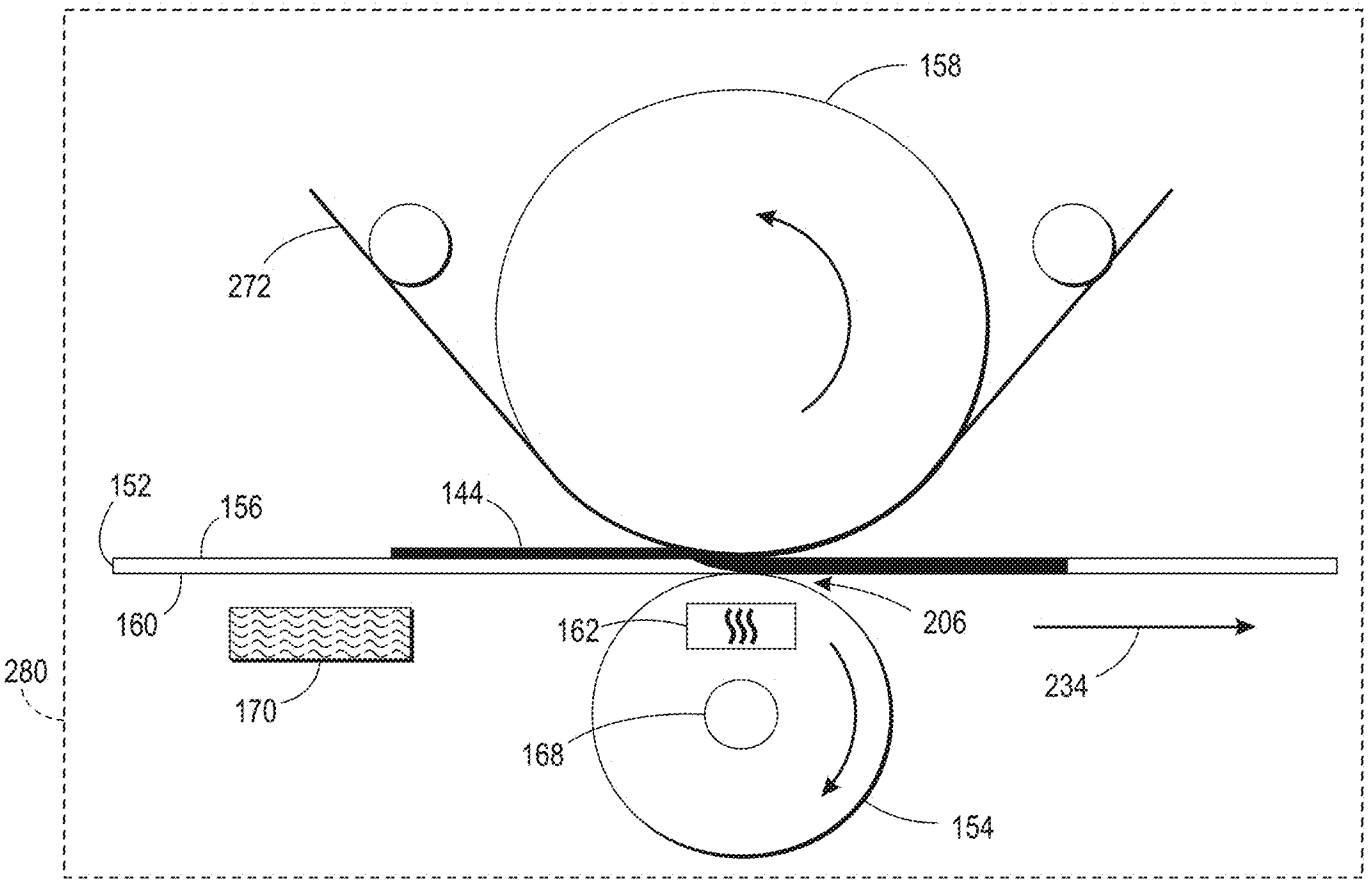
FIG. 2 is a diagram of another embodiment of the apparatus that applies heat and pressure to hydrophobic material on a surface of a substrate.

FIG. 2 depicts another embodiment of an apparatus 280. The apparatus 280 includes some of the components from the apparatus 180, including the first roller 154, second roller 158, first roller heater 162, actuator 168, and substrate heater 170. The apparatus 280 also includes an intermediate web 272 that engages the surface of the second roller 158 and the surface of the substrate 152 in the nip 206 that is formed between the first roller 154 and the second roller 158. In one embodiment, the intermediate web 272 is formed from an endless or cycling silicone rubber belt that engages the substrate 152 and hydrophobic material 144 in the nip 206. The endless belt 272 prevents transfer of the hydrophobic material 144 to the second roller 158, and can be cleaned of any hydrophobic material that transfers to the belt 272 in the nip 206. In another configuration, the intermediate web 272 is a sacrificial material, such as a plastic film or coated paper web, which passes through the nip 206 once and is subsequently discarded or recycled. The apparatus 280 in FIG. 2 applies pressure and a temperature gradient to the hydrophobic material 144 and substrate 152 in a similar manner to the apparatus 180 to enable the hydrophobic material to penetrate the substrate 152.

Figure 3:
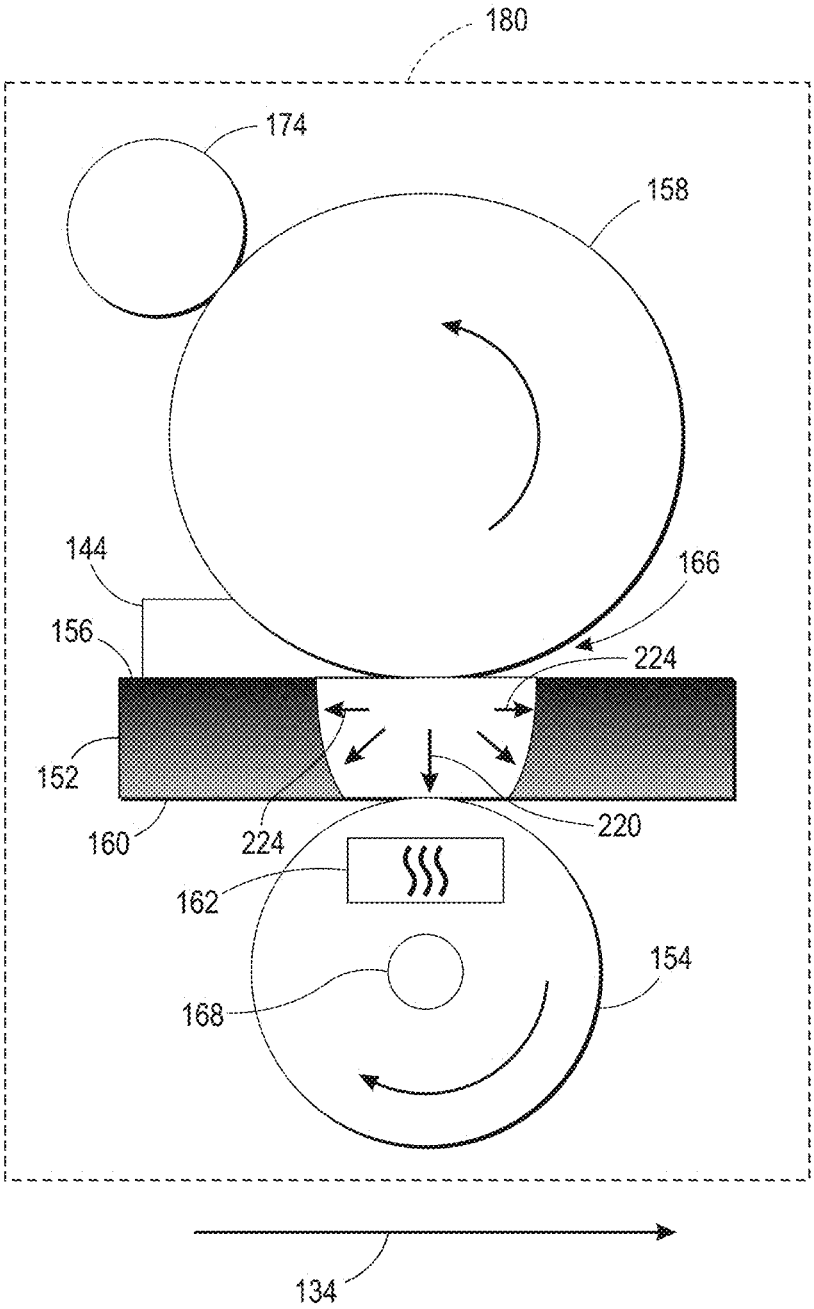
FIG. 3 is a diagram depicting a temperature gradient that is formed in the apparatus of FIG. 1 or FIG. 2 to urge the hydrophobic material to penetrate the substrate.

FIG. 3 depicts the penetration of the hydrophobic material 144 into the substrate 152 in more detail. The elevated temperature and pressure in the nip 106 melt the solidified hydrophobic material 144 and the liquefied hydrophobic material spreads both horizontally and vertically into the porous material in the substrate 152. The spreading distance L of the liquefied hydrophobic material is provided by Washburn's equation:

$$L = \sqrt{\frac{\gamma D t}{4\eta}}$$

where $\gamma$ is the surface tension of the melted hydrophobic material 144, D is the pore diameter of pores in the substrate 152, t is the dwell time of the substrate in the nip during which the temperature gradient and pressure in the nip reduce the viscosity of the hydrophobic material 144, and $\eta$ is the viscosity of the melted hydrophobic liquid. The surface tension $\gamma$ and viscosity $\eta$ terms are empirically determined from the properties of the hydrophobic material 144. The pore diameter D is empirically determined from the type of paper or other hydrophilic material that forms the substrate 152. The apparatus 180 has direct or indirect control over viscosity $\eta$ of the hydrophobic material as the hydrophobic material and substrate move through the temperature gradient that is produced in the nip 166 and time t for how long the hydrophobic material remains in a liquefied state in the nip 166. Hydrophobic materials such as wax or phase-change inks transition into a liquid state with varying levels of viscosity based on the temperature of the material and pressure applied to the hydrophobic material. The viscosity of the liquefied hydrophobic material is inversely related to the temperature of the material. The temperature gradient in the nip reduces the viscosity of the hydrophobic material in the higher-temperature region near the side 160 and roller 154 to a greater degree than on the cooler side 156 and cooler roller 158. Thus, the temperature gradient enables the ink in the higher temperature regions of the temperature gradient to penetrate a longer distance compared to the ink in the cooler regions due to the reduced viscosity at increased temperature.

Figure 10A:
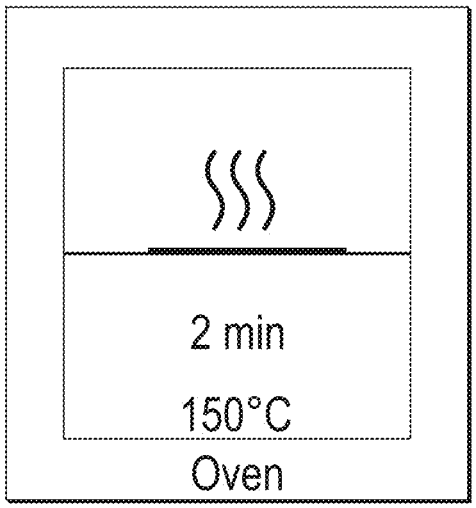
FIG. 10A PRIOR ART
FIG. 10A is a diagram of a prior art reflow oven that melts a hydrophobic material formed on a surface of a substrate.

As is known in the art, the pressure applied in the nip 166 also reduces the effective melting temperature of the hydrophobic material 144 so that the temperature levels required to melt and reduce the viscosity level of the hydrophobic material 144 in the nip 166 are lower than the melting temperature at standard atmospheric pressure. Once a portion of the substrate 152 exits the nip 166, the pressure and temperature levels drops rapidly, which enables the hydrophobic material 144 to return to a solidified state in a more rapid and controlled manner than in the prior art reflow oven depicted in FIG. 10A. The dwell time of each portion of the substrate 152 in the nip 166 also affects the amount of time that the hydrophobic material 144 spends in the liquid state.

In the nip 166, the temperature gradient produces anisotropic heating of the melted hydrophobic material 144. The higher temperature of the first roller 154 on the side 160 reduces the viscosity $\eta$ of the hydrophobic material 144 to a greater degree than on the cooler side 156. Thus, the temperature gradient enables the hydrophobic material 144 to flow into the porous material of the substrate 152 toward the side 160 for a longer distance than the horizontal flow of the hydrophobic material 144 along the length of the substrate 152. In FIG. 3, the longer arrow 220 depicts the longer distance of flow L for the hydrophobic material 144 through the porous material in the substrate toward the high temperature side 160 of the substrate 152, while the shorter arrows 224 indicate a shorter flow distance along the length of the substrate 152. For a phase-change ink hydrophobic material, the reduced viscosity $\eta$ of the ink as the ink penetrates the substrate 152 towards the higher temperature roller 154 enables the phase-change ink to penetrate through the substrate from the printed surface 156 to the second side 160, which forms a layer of the phase-change ink through the entire thickness of the substrate 152.

Figure 10B:
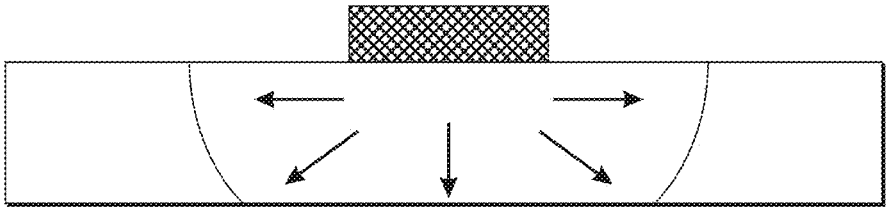
FIG. 10B PRIOR ART
FIG. 10B is a diagram depicting the spread of hydrophobic material on a substrate in the reflow oven of FIG. 10A in a prior art spreading process.

The apparatus 180 generates the anisotropic temperature gradient and liquid flow patterns for the hydrophobic material 144 to form printed lines and other printed features with the hydrophobic material 144 that exhibit less spread along the length of the substrate 152 and improved penetration through the substrate 152 to from the printed side 156 to the blank side 160. For example, in one embodiment the horizontal width of a printed channel barrier line that is formed with the apparatus 180 is approximately 650 μm while the prior-art reflow oven embodiment of FIG. 10A spreads the same printed line to a width of approximately 1000 μm. Furthermore, the anisotropic temperature gradient in the apparatus 180 enables the hydrophobic material 144 to penetrate into the substrate 152 to a greater degree than the prior art reflow oven with the isotropic temperature distribution depicted in FIG. 10B. The narrower width of the barriers enables the production of smaller devices with finer feature details, and also improves the effectiveness of the fluid channels that control the capillary diffusion of fluids through the substrate.

Figure 4:
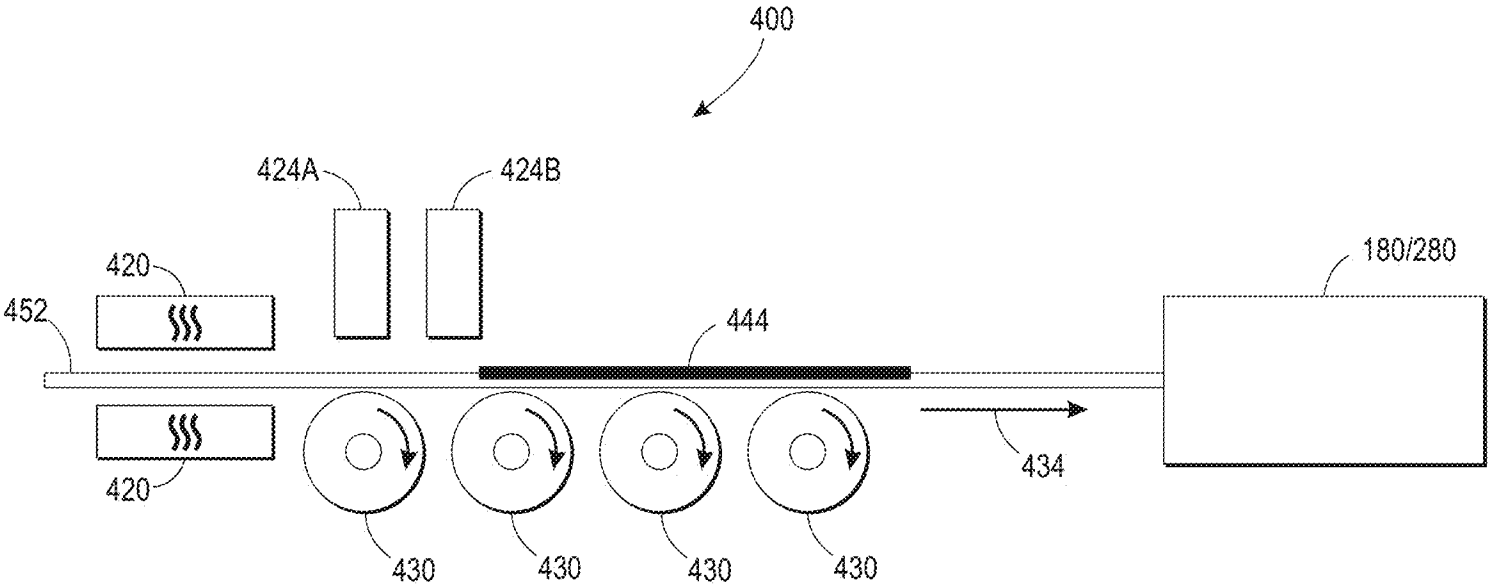
FIG. 4 is a diagram of another embodiment of an inkjet printer configuration that applies multiple layers of a hydrophobic material to a surface of a substrate before the apparatus of FIG. 1 or FIG. 2 applies heat and pressure to enable the hydrophobic material to penetrate the substrate.

FIG. 4 depicts another embodiment of an inkjet printer 400 that deposits a pattern of hydrophobic material 444 onto a substrate 452. The inkjet printer 400 is a direct inkjet printer where multiple sets of printheads, such as printheads 424A and 424B, in a print zone eject the hydrophobic material directly onto the substrate 452. The substrate 452 is illustrated as an elongated media web. Heaters 420 heat the substrate 452 to a predetermined temperature, such as 60° C., as the substrate 452 enters the print zone. In the example of FIG. 4, the printheads 424A and 424B form two layers of the hydrophobic material 444 in a predetermined pattern on the substrate 452, although other printer embodiments include additional printheads to form the printed patterns with additional layers of the hydrophobic material. In the printer 400, the rollers 430 are part of a media transport that moves the substrate through the print zone as indicated by the arrow 434. The substrate 452 subsequently moves through the apparatus 180 or 280 that apply the temperature gradient and pressure to enable the hydrophobic material 444 to penetrate through the substrate 452. The apparatus 180 or 280 is incorporated into the printer 400 in one embodiment. In another embodiment, the apparatus 180 or 280 receives the substrate 452 during a finishing or other processing that occurs after printing with the printer 400.

Figure 5:
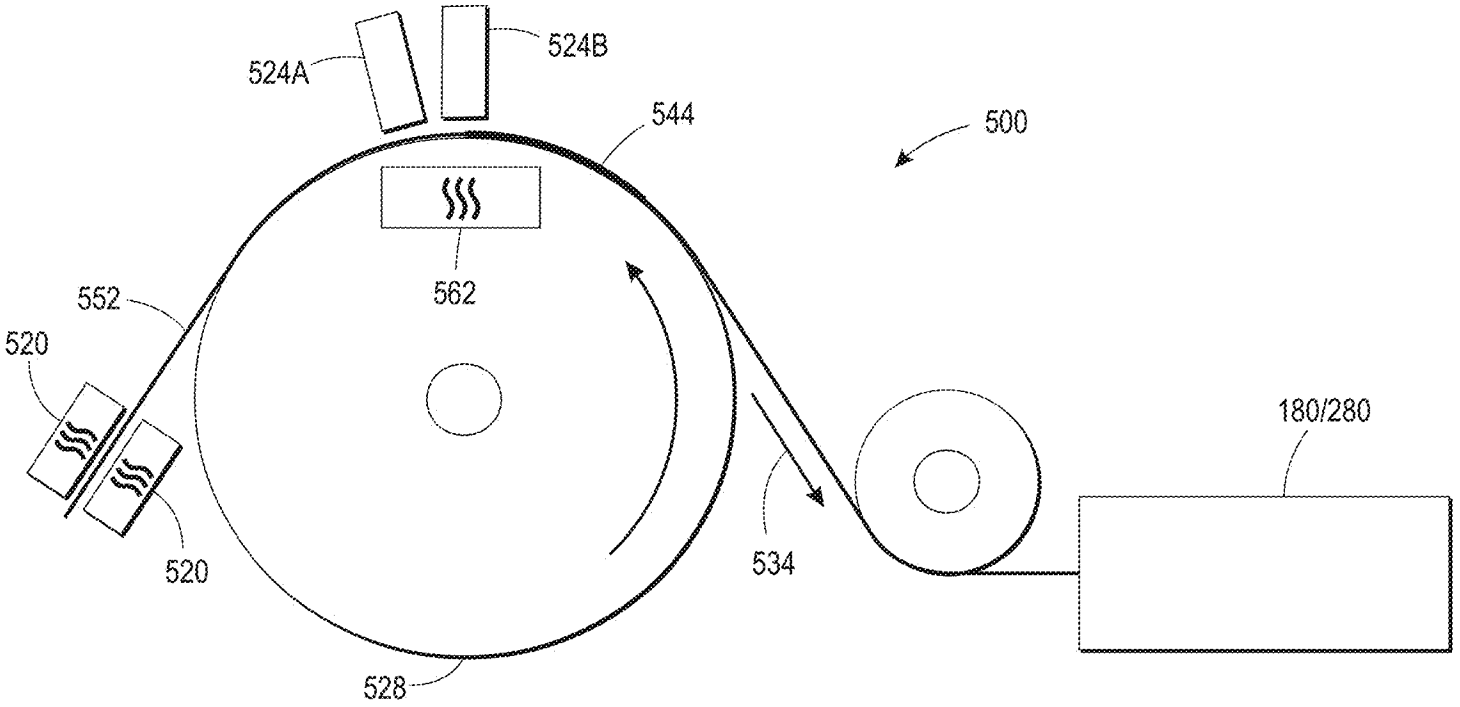
FIG. 5 is a diagram of another embodiment of an inkjet printer configuration that applies multiple layers of a hydrophobic material to a surface of a substrate before the apparatus of FIG. 1 or FIG. 2 applies heat and pressure to enable the hydrophobic material to penetrate the substrate.

FIG. 5 depicts another configuration of an inkjet printer 500 that deposits a pattern of hydrophobic material 544 onto a substrate 552. In the printer 500, the substrate 552 is an elongated web of paper or another substrate material that passes multiple printheads, such as printheads 524A and 524B, in a print zone to receive a printed pattern with multiple layers of a hydrophobic material 544. While FIG. 5 depicts two sets of printheads 524A and 524B that form two layers of the hydrophobic material in the substrate 552, another configuration of the printer 500 forms three or more layers of the hydrophobic material using additional printheads. The printer 500 includes substrate heaters 520 that heat the substrate 552 as the substrate 552 approaches the print zone. In the printer 500, the substrate 552 engages a rotating backer roller 528 that supports the substrate 552 as the substrate 552 moves past the printheads 524A and 524B in the print zone. The backer roller 528 includes a heater 562 to maintain the temperature of the substrate 552 at a predetermined temperature (e.g. 60° C.) during the printing process. The substrate 552 subsequently exits the print zone as indicated by arrow 534 and enters the apparatus 180 or 280. The apparatus 180 or 280 is incorporated into the printer 500 in one embodiment. In another embodiment, the apparatus 180 or 280 receives the substrate 452 during a finishing or other processing that occurs after printing with the printer 500.

Figure 6:
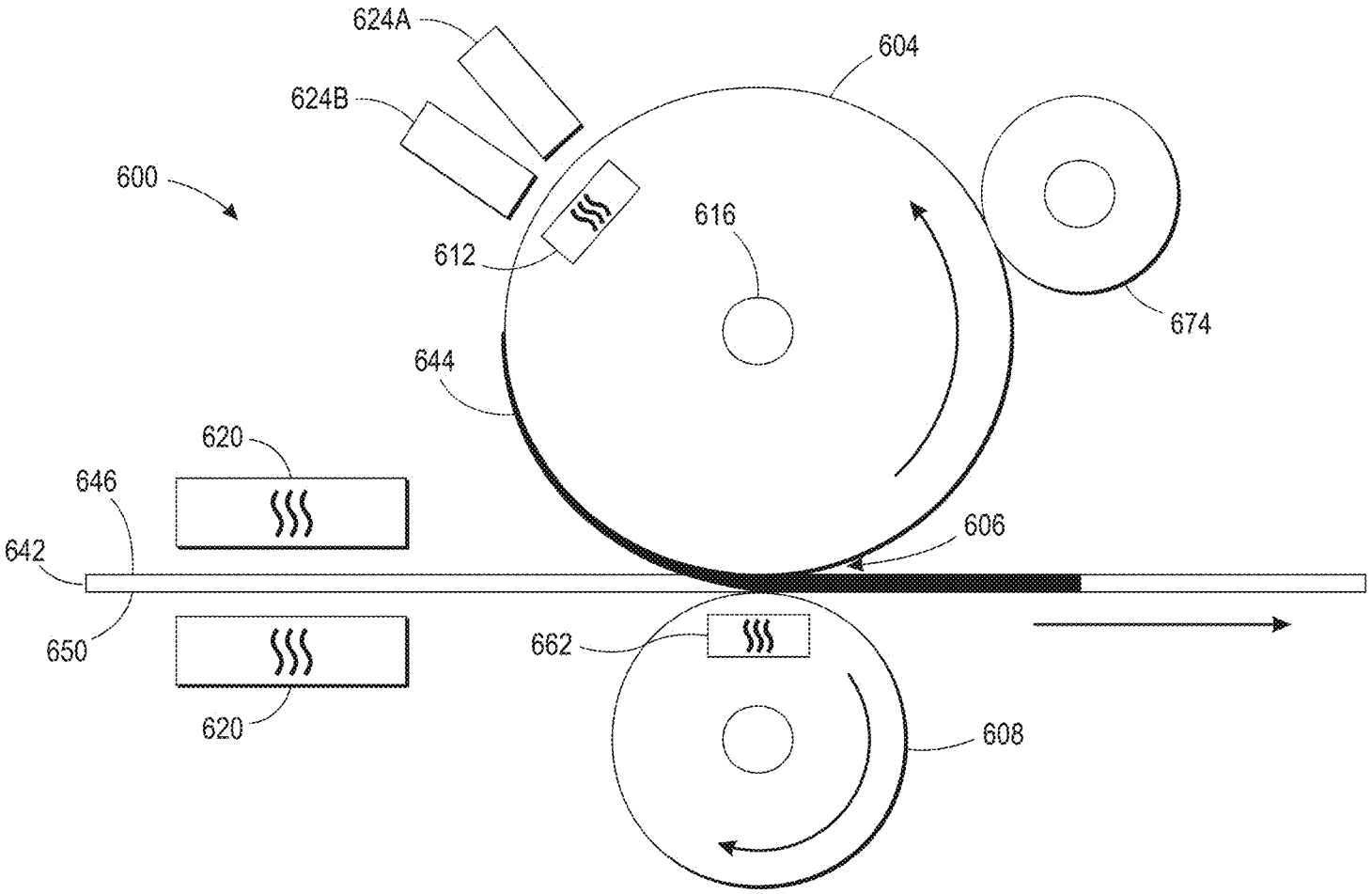
FIG. 6 is a diagram of an inkjet printer that applies multiple layers of a hydrophobic material to a first drum and applies heat and pressure to the hydrophobic material and a substrate to enable the hydrophobic material to penetrate the substrate.

FIG. 6 depicts another embodiment of an inkjet printer 600 that incorporates the functionality of the apparatuses 180 and 280. The inkjet printer includes an imaging drum 604, transfix roller 608, substrate heaters 620, printheads 624A and 624B, and a cleaning roller 674. The imaging drum 604 engages the transfix roller 608 to form a nip 606. The printheads 624A and 624B each eject a layer of a phase-change ink or other hydrophobic material to form a hydrophobic material image 644 on the surface of the imaging drum 604. As with the embodiments of FIG. 4 and FIG. 6, the printer 600 optionally includes additional printheads to form additional layers of the hydrophobic material on the imaging drum 604, or the imaging drum 604 completes multiple rotations past one or more printheads to form a multi-layer printed image in a multi-pass printing configuration prior to moving the substrate 642 through the nip 606.

In the printer 600, imaging drum 604 optionally includes a heater 612 that heats the surface of the imaging drum 604 to a predetermined temperature (e.g. 60° C.) as the imaging drum 604 rotates past the printheads 624A and 624B. The printer 600 also includes one or more electrical, pneumatic, or hydraulic actuators that engage the imaging drum 604 and the transfix roller 608 in the nip 606 with a predetermined pressure level, such as a 1,000 PSI pressure level. The transfix roller 608 includes another heater 662 that heats the surface of the transfix roller 608 to a higher temperature than the surface of the imaging drum 604 in the nip 606. For example, in one embodiment the surface temperature of the transfix roller 608 in the nip 606 is approximately 100° C. while the surface temperature of the imaging drum 604 is approximately 60°-70° C.

During operation, the printer 600 forms a temperature gradient in the nip 606 in a similar manner to the configurations of the apparatuses 180 and 280. The hydrophobic material pattern 644 on the lower temperature imaging drum 604 transfers to one side 646 of the substrate 642 in the nip 606, and the temperature gradient in the nip 606 enables the hydrophobic material 644 to penetrate through the substrate 642 toward the side 650 that engages the higher temperature transfix roller 608. In the configuration of the printer 600, the transfix roller 608 acts as the higher temperature first roller from the apparatuses 180 and 280 and the imaging drum 604 acts as the lower temperature second roller in the apparatuses 180 and 280. The imaging drum 604 continues rotation through the nip 606 and passes the cleaning roller 674, which removes and residual phase-change ink or other hydrophobic material from the surface of the imaging drum 604.

The inkjet printers and apparatuses described above form predetermined patterns of hydrophobic material on a hydrophilic substrate, such as a paper, to form fluid channels and other features that control the diffusion of a liquid through the substrate. As described above, chemical assay devices are one example of a class of devices include a substrate with fluid channels that are formed with the hydrophobic material. Selected regions of the chemical assay include a variety of chemicals, including reagents, catalysts, indicators, buffers, and the like that are used with the biomedical testing device. In some embodiments, an inkjet printer applies the chemicals to different regions of the substrate after the hydrophobic material has been applied to the substrate to form the fluid channels.

Figure 7:
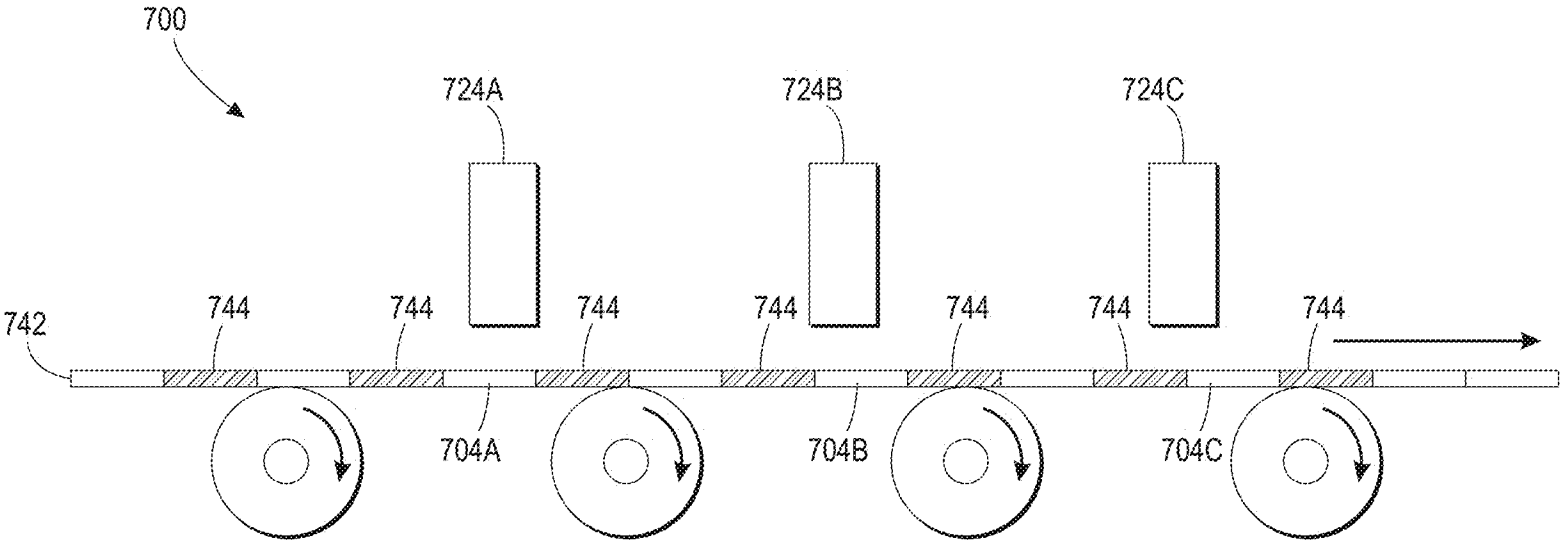
FIG. 7 is a diagram of an inkjet printer that ejects liquid drops including reagents or other chemicals onto fluid channels in the substrate that are defined by the hydrophobic material in the substrate.

FIG. 7 depicts an embodiment of an inkjet printer 700 with printheads 724A-724C. In the configuration of FIG. 7, each of the printheads 724A-724C ejects liquid drops that include a chemical for use with a chemical assay device that is configured as a biomedical sensor formed from the substrate 742. In another configuration, the printer includes a different number of printheads for printing a different combination of chemicals or each of the printheads is configured with multiple liquid reservoirs to enable the ejection of different types of chemical from different groups of inkjets in a single printhead. In the substrate 742, the regions 744 are formed from a hydrophobic material that substantially penetrates the entire thickness of the substrate 742 to form hydrophobic structures including barriers and fluid channels for liquids that are absorbed by exposed regions of the substrate 742, such as the regions 704A, 704B, and 704C. The printheads 724A-724C eject drops of liquid that include one or more selected chemicals onto different exposed regions in the substrate 742. For example, the printheads 724A-724C eject liquid drops with different chemicals into the regions 704A-704C, respectively, in the configuration of FIG. 7. The liquid drops include a carrier chemical such as water, alcohol, or another solvent that carries the chemical as a solution or suspension. After passing the printheads 724A-724C, the liquid carrier dries from the substrate 742 and leaves the chemical deposited in the substrate 742 for later use in a chemical assay or biomedical testing device.

Figure 8:
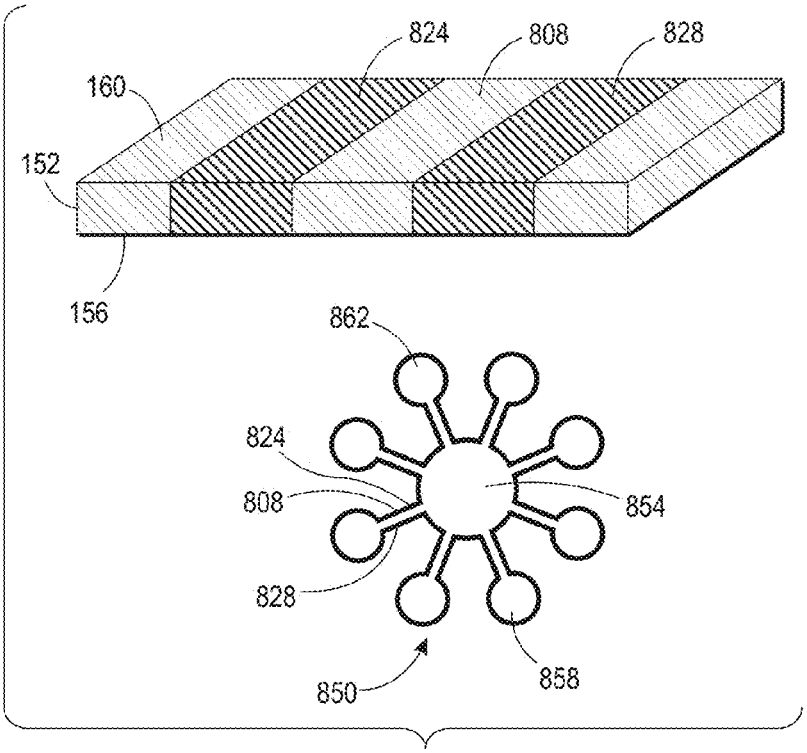
FIG. 8 is a cross-sectional view and a plan view of a biomedical test device formed in a substrate with fluid channels in the substrate that are formed by the hydrophobic material.
Figure 9:
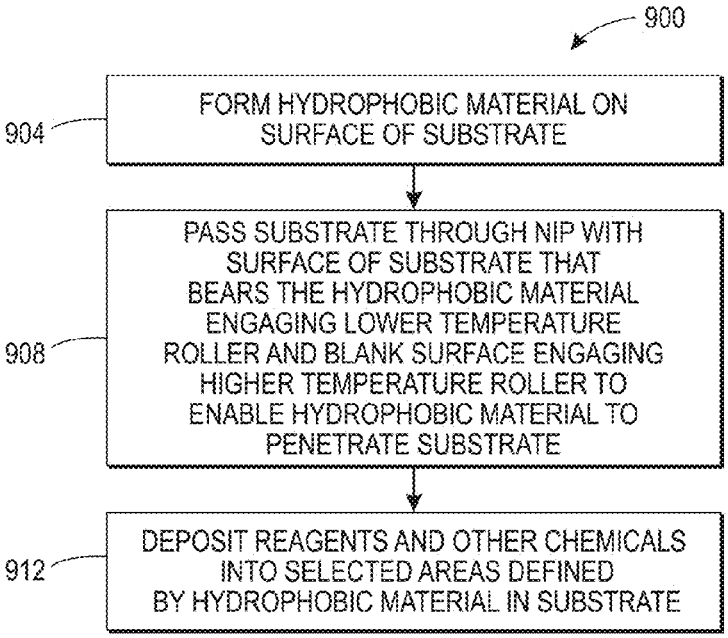
FIG. 9 is a block diagram of a process for applying heat and pressure to a hydrophobic material formed on a surface of a substrate to enable the hydrophobic material to penetrate the substrate.

FIG. 8 depicts an example of a printed pattern in a biomedical test device 850 that includes a deposit location and fluid channels formed from the hydrophobic material in the substrate to direct the fluid to different locations where chemical reagents react with the fluid. The substrate 152 includes the barriers 824 and 828 that are formed from the hydrophobic material 144. The apparatus 180 enables the hydrophobic material in the barrier hydrophobic structures 824 and 828 to penetrate through the thickness of the substrate 152 between the sides 156 and 160 to fully surround a fluid channel 808. The hydrophilic substrate 152 absorbs a fluid sample and the fluid moves through the channel 808 through capillary diffusion, while the barriers 824 and 828 prevent the fluid from leaving the channel 808. The biomedical detection device 850 includes the substrate 152, the hydrophobic barriers that are formed in the substrate to control the diffusion of fluids, a deposit site 854, and a set of reaction sites such as the reaction sites 858 and 862. During operation, a fluid sample is deposited in the central deposit site 854. While not depicted in FIG. 8, a mask layer is typically formed over the printed device 850 to ensure that fluid samples are only absorbed at the deposit site 854. The fluid sample propagates through the hydrophilic substrate 152 through the channels that are formed by the hydrophobic material and to an array of reaction sites. Each of the reaction sites includes a chemical reagent that is embedded in the substrate 152. The chemical reagents react with different chemical compounds in the fluid sample and change color or produce another indicator that can be used to analyze the fluid sample. For example, the reaction site 858 tests for anemia while the reaction site 862 tests for the glucose (blood sugar) level in a single blood sample that is placed in the deposit site 854.

FIG. 4 depicts a block diagram of a process 900 for applying and spreading a hydrophobic material through a substrate. The process 900 is described in conjunction with the apparatus 180 of FIG. 1, the apparatus 280 of FIG. 2, the illustrative example of the nip and temperature gradient of FIG. 3, and the biomedical testing device 850 of FIG. 8 for illustrative purposes.

Process 900 begins with an optional process of forming a hydrophobic material on a surface of a substrate (block 904). As described above, in one embodiment the apparatus 180 is incorporated in an inkjet printer, and the inkjet printheads 124 eject liquid drops of the hydrophobic material in predetermined patterns, such as the pattern depicted in the biomedical testing device 850. The substrate transport moves a blank substrate through the nip and the hydrophobic material is transferred to a printed side of the substrate.

Process 900 continues as the substrate with the hydrophobic material passes through a nip formed from two rollers that are heated to different temperatures with a blank side of the substrate engaging the roller with the higher temperature and the side of the substrate that bears the hydrophobic material engaging the roller with the lower temperature (block 908). As depicted above in FIG. 1, in one configuration the heater 162 heats the first roller 154 to 100° C. while the second roller 158 remains at a lower temperature of approximately 60-70° C. In alternative configurations, the heater 162 heats the first roller 154 to an elevated temperature of 70° C. to 140° C. The second roller 158 remains at a lower temperature than the first roller 154 to produce the temperature gradient in the nip 166. As the substrate moves through the nip 166, the blank side 160 is heated to a higher temperature and the printed side 156 is heated to a lower temperature due to the temperature gradient between the rollers 154 and 158. As depicted in FIG. 3, the hydrophobic material liquefies and flows through the thickness of the substrate 152. The temperature gradient in the nip 166 enables the hydrophobic material to flow in an anisotropic manner with a greater portion of the liquid flow being directed into the substrate from the printed side 156 to the blank side 160 to form barriers and channels that control the diffusion of fluids through the hydrophilic material in the substrate 152.

Process 900 continues with the optional application of reagents or other chemicals to the regions of the hydrophilic substrate that are defined by the hydrophobic fluid channel barriers (block 912). As depicted above with reference to FIG. 7, an inkjet printer can eject liquid drops that include various chemicals onto regions of the substrate that are defined by the hydrophobic material. A single chemical assay or biomedical testing device can include multiple chemicals that are deposited into different regions of the substrate and are isolated from each other by the fluid channels that are formed by the hydrophobic material. In the process 900, the chemicals are formed on the substrate after the formation of the fluid channels with the hydrophobic material to prevent cross-contamination between different chemicals that are ejected onto a single substrate and because the application of heat and pressure to enable the hydrophobic material to penetrate the substrate may produce undesirable reactions with many chemicals that are used in chemical sensors or biomedical testing devices.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An apparatus for distributing a hydrophobic material in a substrate comprising:

a first roller;

a second roller configured to engage the first roller to form a nip;

a first heater operatively connected to the first roller and configured to heat the first roller to a first temperature that is greater than a second temperature of the second roller;

a printhead having a plurality of inkjets configured to eject drops of hydrophobic material in a predetermined pattern on the second roller; and a substrate transport configured to move a substrate through the nip at least twice at a predetermined linear velocity of approximately 5 inches per second to enable the first roller to engage a first side of the substrate and the second roller to engage a second side of the substrate to melt the two predetermined patterns of hydrophobic material to and enable the two predetermined patterns of hydrophobic material to penetrate into the second side of the substrate in response to a temperature gradient in the nip between the first roller and the second roller.

2. The apparatus of claim 1, the inkjets of the printhead being further configured to eject drops of melted wax.

3. The apparatus of claim 1, the inkjets of the printhead being further configured to eject drops of melted phase-change ink.

4. The apparatus of claim 1 further comprising:

a second heater positioned on the substrate transport prior to the nip and configured to heat the substrate to a predetermined temperature.

5. The apparatus of claim 1, the substrate transport further comprising:

an actuator configured to rotate the first roller and the second roller at the predetermined linear velocity.

6. The apparatus of claim 1 wherein the first temperature is in a range of approximately 70° to 140° C.

7. The apparatus of claim 1 wherein the predetermined linear velocity enables a predetermined portion of the substrate to remain in the nip in a range of approximately 0.1 seconds to 10 seconds.

8. The apparatus of claim 1, the second roller being configured to engage the first roller with a predetermined pressure to enable the nip to urge the hydrophobic material into the second side of the substrate.

9. The apparatus of claim 8 wherein the predetermined pressure is in a range of approximately 800 pounds per square inch (PSI) to 3,000 PSI.

10. A method for distributing a hydrophobic material in a substrate comprising:

engaging a first roller with a second roller to form a nip;

heating the first roller with a first heater operatively connected to the first roller to heat the first roller to a first temperature that is greater than a second temperature of the second roller;

operating a plurality of inkjets in a printhead to eject drops of a hydrophobic material onto the second roller to form a predetermined pattern of the hydrophobic material on the second roller; and moving a substrate having a first side and a second side through the nip at least twice at a predetermined linear velocity of approximately 5 inches per second with a substrate transport to enable the first roller to engage the first side of the substrate and the second roller to engage the second side of the substrate to melt the two predetermined patterns of the hydrophobic material and enable the two predetermined patterns of hydrophobic material to penetrate into the second side of the substrate in response to a temperature gradient in the nip between the first roller and the second roller.

11. The method of claim 10, the heating of the first roller further comprising:

heating the first roller to a first temperature effective for penetrating the second side of the substrate with wax ejected on the second roller in the two predetermined patterns.

12. The method of claim 10, the heating of the first roller further comprising:

heating the first roller to a first temperature effective for penetrating the second side of the substrate with a phase change ink ejected on the second roller in the two predetermined patterns.

13. The method of claim 10 further comprising:

heating the substrate transport with a second heater prior to the nip to heat the substrate to a predetermined temperature.

14. The method of claim 10 further comprising:

rotating the first roller and the second roller at the predetermined linear velocity with an actuator.

15. The method of claim 10 wherein the first roller is heated to a temperature in a range of approximately 70° C. to 140° C.

16. The method of claim 10 wherein the substrate is moved through the nip at the predetermined linear velocity that enables a predetermined portion of the substrate to remain in the nip in a range of approximately 0.1 seconds to 10 seconds.

17. The method of claim 10 further comprising:

engaging the first roller with the second roller at a predetermined pressure to enable the nip to urge the hydrophobic material into the second side of the substrate.

18. The method of claim 17 wherein the second roller engages the first roller at the predetermined pressure of in a range of approximately 800 pounds per square inch (PSI) to 3,000 PSI.

* * * * *